US009949016B2

(12) United States Patent
Huang

(10) Patent No.: US 9,949,016 B2
(45) Date of Patent: Apr. 17, 2018

(54) EARPHONE DEVICE HAVING CONCENTRATING TUBE

(71) Applicant: Jetvox Acoustic Corp., Taoyuan (TW)

(72) Inventor: To-Teng Huang, Taoyuan (TW)

(73) Assignee: Jetvox Acoustic Corp., Taoyuan (TW)

( * ) Notice: Subject to any disclaimer, the term of this patent is extended or adjusted under 35 U.S.C. 154(b) by 0 days.

(21) Appl. No.: 15/291,503

(22) Filed: Oct. 12, 2016

(65) Prior Publication Data

US 2017/0280227 A1 Sep. 28, 2017

(30) Foreign Application Priority Data

Mar. 25, 2016 (TW) ..... 105204256 U

(51) Int. Cl.

| | |
|---|---|
| ***H04R 1/10*** | (2006.01) |
| ***H04R 1/28*** | (2006.01) |
| ***H04R 1/34*** | (2006.01) |
| ***H04R 9/06*** | (2006.01) |

(52) U.S. Cl.

CPC ..... *H04R 1/1075* (2013.01); *H04R 1/2834* (2013.01); *H04R 1/345* (2013.01); *H04R 9/06* (2013.01)

(58) Field of Classification Search

CPC ..... G10K 11/175; H04R 1/02; H04R 1/1075; H04R 1/1091; H04R 9/02; H04R 9/046; H04R 1/10

USPC ..... 162/159; 181/148, 160, 171; 310/12.24; 381/55, 74, 111, 162, 182, 184, 186, 345, 381/351, 373, 380, 396, 397, 398, 400, 381/404, 405, 407, 412, 413, 414, 420, 381/421, 423, 433, 313, 328, 334; 455/569.1

See application file for complete search history.

(56) References Cited

U.S. PATENT DOCUMENTS

| | | | | |
|---|---|---|---|---|
| 4,005,278 | A * | 1/1977 | Gorike | H04R 5/033 181/137 |
| 4,429,194 | A * | 1/1984 | Kamon | H04R 1/1016 381/371 |
| 9,319,767 | B2 * | 4/2016 | Sakaguchi | H04R 1/10 |
| 2006/0050921 | A1 * | 3/2006 | Kaiya | H04R 9/022 381/397 |
| 2006/0093181 | A1 * | 5/2006 | Kasahara | H04R 7/127 381/421 |

(Continued)

*Primary Examiner* — Gerald Gauthier

(74) *Attorney, Agent, or Firm* — Muncy, Geissler, Olds & Lowe, P.C.

(57) ABSTRACT

An earphone device having a concentrating tube includes an annular magnet, a first yoke, a second yoke, a concentrating tube, a speaker assembly, and a passive diaphragm. The first and second yokes are respectively connected to first and second magnetic pole surfaces of the annular magnet. The concentrating tube is received in a central through hole of the annular magnet. The concentrating tube includes first and second open ends. The speaker assembly includes a voice coil and an active diaphragm. The passive and active diaphragms are at two opposite ends of the concentrating tube. The active and passive diaphragms are respectively close to the first and second open ends. A gas flow generated by the active diaphragm is gathered by the concentrating tube and pushes the passive diaphragm. A gas flow generated by the passive diaphragm returns through the concentrating tube to push the active diaphragm and transmits acoustic waves.

9 Claims, 9 Drawing Sheets

(56) References Cited

U.S. PATENT DOCUMENTS

| | | | | |
|---|---|---|---|---|
| 2008/0013780 | A1* | 1/2008 | Kobayashi | H04R 9/043 381/398 |
| 2009/0233652 | A1* | 9/2009 | Yang | H04R 1/1075 455/569.1 |
| 2010/0027833 | A1* | 2/2010 | Takahashi | H04R 9/025 381/413 |
| 2011/0116678 | A1* | 5/2011 | Wang | H04R 9/043 381/407 |
| 2012/0008815 | A1* | 1/2012 | Humphreys | H04R 9/04 381/400 |
| 2012/0163637 | A1* | 6/2012 | Chen | H04R 1/24 381/184 |
| 2013/0064414 | A1* | 3/2013 | Flavignard | H04R 1/24 381/412 |
| 2014/0056455 | A1* | 2/2014 | Sakaguchi | H04R 1/2811 381/328 |
| 2014/0064541 | A1* | 3/2014 | Guenther | H04R 1/288 381/351 |
| 2015/0023545 | A1* | 1/2015 | Kumakura | H04R 9/022 381/412 |
| 2015/0230033 | A1* | 8/2015 | Sprague | H04R 25/604 381/313 |
| 2015/0326975 | A1* | 11/2015 | Takada | H04R 3/00 381/407 |
| 2017/0105072 | A1* | 4/2017 | Katsumata | H04R 9/02 |
| 2017/0280227 | A1* | 9/2017 | Huang | H04R 1/1075 |

* cited by examiner

EARPHONE DEVICE HAVING CONCENTRATING TUBE

CROSS-REFERENCE TO RELATED APPLICATION

This non-provisional application claims priority under 35 U.S.C. § 119(a) to Patent Application No. 105204256 filed in Taiwan, R.O.C. on Mar. 25, 2016, the entire contents of which are hereby incorporated by reference.

BACKGROUND

Technical Field

The instant disclosure relates to a field of earphone and, more particularly, to an earphone device having a concentrating tube.

Related Art

Conventional earphones perform electro-acoustic conversions by moving coil drivers. The moving coil driver includes a voice coil, a permanent magnet, and a diaphragm. When audio signals are transmitted to the voice coil by an audio line, the voice coil generates a magnetic field based upon electromagnetic induction. The diaphragm is vibrated by the interaction of the magnetic field generated by the electromagnetic induction and the magnetic field generated by the permanent magnet, and the audio signals are converted into acoustic waves for outputting.

The audio signals include a part of low frequency and a part of high frequency. The part of low frequency and the part of high frequency have different characteristics in terms of frequency response. According to prior techniques, the parts of low frequency and the high frequency are processed by electro-acoustic conversions through the single diaphragm; however, it is hard to produce clear sound by the single diaphragm due to different characteristics of frequency response. Distortion may occur during the electro-acoustic conversions, which results in outputted sound being unclear. Although two moving coil drivers can be adopted in an earphone to resolve the issue by having the two drivers respectively generate acoustic waves of high frequency and low frequency via a frequency dividing circuit, this increases the size of the earphone, making it unsuitable for use.

In addition, the pressure of gas inside the earphone directly affects the vibration of the diaphragm and consequently affects the frequency response thereof. When the diaphragm vibrates due to the pressure of gas inside the earphone being greater than that of gas outside the earphone, the vibration of the diaphragm is restrained by the gas with greater pressure, meaning that the amplitude of vibration of the diaphragm is depressed. As a result, certain frequency range(s) of sound that the earphone should generate, is lost.

SUMMARY

To address the above issues, the instant disclosure provides an earphone device having a concentrating tube capable of providing clearer sound and being suitable for use in terms of size. The earphone device comprises an annular magnet, a first yoke, a second yoke, a concentrating tube, a speaker assembly, and a passive diaphragm.

The annular magnet comprises a central through hole, a first magnetic pole surface, and a second magnetic pole surface. The first magnetic pole surface and the second magnetic pole surface have different magnetism and are respectively at two opposite sides of the annular magnet. In the embodiment, the first magnetic pole surface and the second magnetic pole are, but not limited to, two opposite surfaces in an axial direction. The first yoke is connected to the first magnetic pole surface of the annular magnet. The first yoke comprises a central hole coaxial with the central through hole. The second yoke comprises a top plate and an outer annular wall. The top plate is connected to the second magnetic pole surface of the annular magnet. The top plate comprises a central opening coaxial with the central through hole. The outer annular wall is around a periphery of the top plate.

The concentrating tube is received in the central through hole of the annular magnet. The concentrating tube comprises a first open end and a second open end. The speaker assembly comprises a voice coil and an active diaphragm. The voice coil is assembled to the active diaphragm and extending axially in between the first yoke and the outer annular wall. The voice coil is radially spaced from both of the first yoke and the outer annular wall by gaps. The passive diaphragm and the active diaphragm are respectively at two opposite ends in an axial direction of the concentrating tube. The active diaphragm is close to the first open end. The passive diaphragm is close to the second open end.

According to an embodiment, a diameter of the first open end of the concentrating tube is greater than that of the second open end of the concentrating tube. The diameter of the concentrating tube decreases from the first open end towards the second open end; consequently, a gas flow flowing through the concentrating tube can be gathered, and the flow velocity of the gas flow can be changed, so that the passive diaphragm can be pushed by the gas with greater kinetic energy. Further, the diameter of the concentrating tube linearly or nonlinearly decreases from the first open end towards the second open end.

According to an embodiment, the first yoke further comprises an inner axial tube. The inner axial tube extends along an axial direction of the central hole and is disposed in the central through hole of the annular magnet. The concentrating tube is fixed in the inner axial tube.

According to an embodiment, there is a plurality of dividing channels disposed in the second open end of the concentrating tube. The dividing channels are equiangularly arranged and are disposed equally towards the passive diaphragm, by which the passive diaphragm can equally bear gas flows.

According to an embodiment, the earphone device having a concentrating tube further comprises a dividing unit. The dividing unit is received in the central through hole of the annular magnet and is close to the second open end of the concentrating tube. The dividing unit comprises a plurality of dividing channels. The dividing channels are equiangularly arranged and are disposed equally towards the passive diaphragm, by which the passive diaphragm can equally bear gas flows. In other words, the concentrating tube and the dividing unit can be integrated into one piece, or can be individual components. Further, the first yoke further comprises an inner axial tube. The inner axial tube extends along an axial direction of the central hole and is disposed in the central through hole of the annular magnet. The dividing unit is fixed to an end of the inner axial tube.

According to an embodiment, the concentrating tube further comprises a fixing element and the concentrating tube is fixed to the first yoke by the fixing element. The fixing element is disposed around a periphery of the concentrating tube. Alternatively, the fixing element can be one or more extending elements, by which the concentrating tube is fixed to the first yoke by the fixing element.

According to an embodiment, the passive diaphragm is fixed to the top plate of the second yoke, and the active diaphragm is fixed to the outer annular wall of the second yoke. In other words, the passive diaphragm and the active diaphragm are respectively disposed at two sides of the concentrating tube. In the embodiment, the diaphragm at the top plate of the second yoke is the passive diaphragm. Alternatively, under the circumstance that the voice coil and the concentrating tube are reversely disposed, the diaphragm at the outer annular wall of the second yoke can be the passive diaphragm.

According to the above embodiments, the earphone device having a concentrating tube comprises the concentrating tube, the active diaphragm, and the passive diaphragm. The earphone device is suitable for use in terms of size because only one diaphragm is added, and two moving coil drivers are not required. In addition, a gas flow generated by the active diaphragm is gathered by the concentrating tube and then pushes and vibrates the passive diaphragm. A gas flow generated by the passive diaphragm returns through the concentrating tube to push the active diaphragm and also transmits acoustic waves produced by the passive diaphragm; consequently, the acoustic waves of the passive diaphragm reinforces a part of frequency of sound which is unclear in the situation that the sound is only generated by the active diaphragm. Meanwhile, since the gas flow pushes the active diaphragm, the amplitude of vibration of the active diaphragm is increased to reach a frequency raising effect.

DETAILED DESCRIPTION

Figure 1:
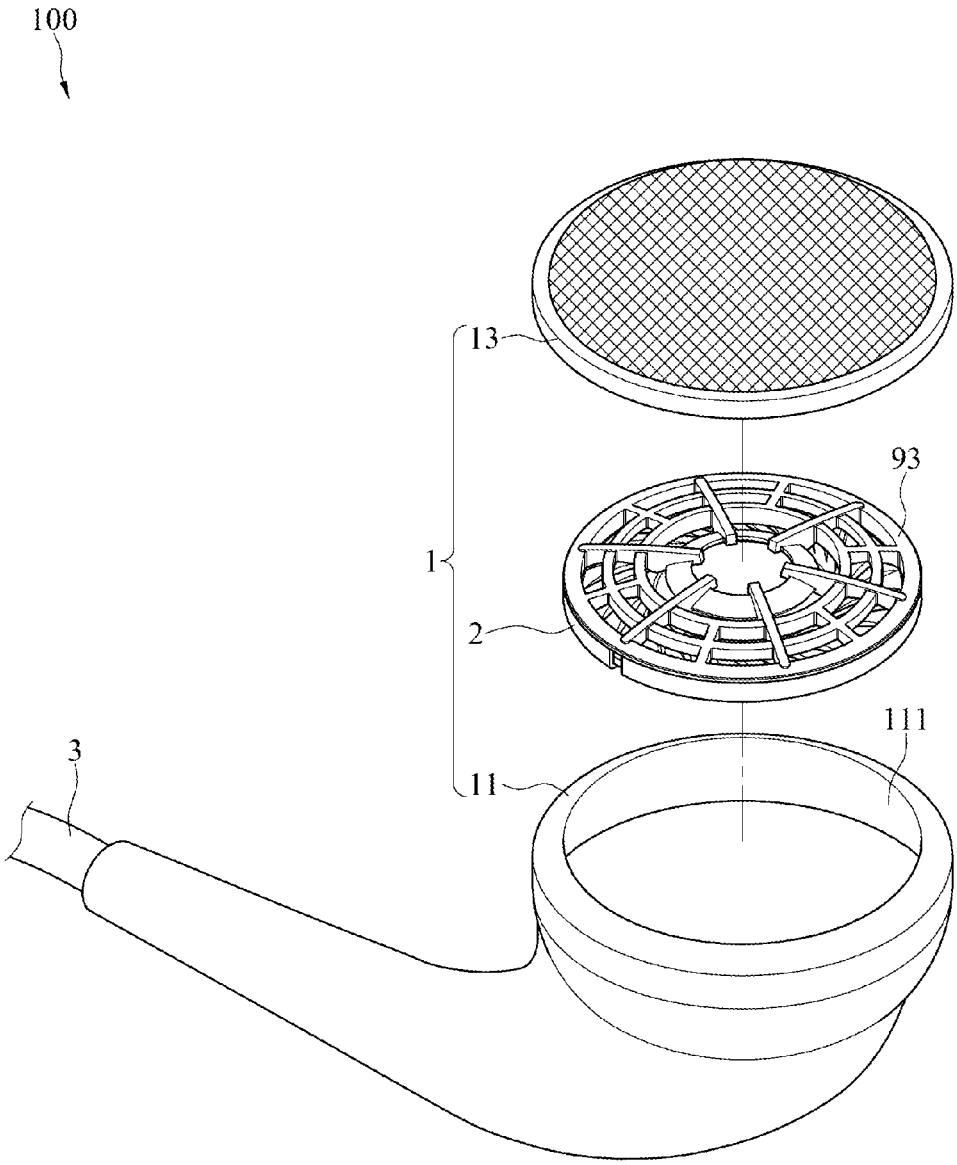
FIG. 1 illustrates a partial exploded view of an earphone device having a concentrating tube according to an embodiment of the instant disclosure.

Please refer to FIGS. 1, 2A, 2B, and 3, in which FIGS. 1, 2A, 2B, and 3 are respectively a partial exploded view of an earphone device having a concentrating tube, an exploded view in a viewing angle of the earphone device, an exploded view in another viewing angle of the earphone device, and a cross sectional view of the earphone device according to an embodiment of the instant disclosure. As shown in FIGS. 1, 2A, 2B, and 3, the earphone device 100 comprises an annular magnet 20, a first yoke 30, a second yoke 40, a concentrating tube 50, a speaker assembly 60, and a passive diaphragm 70. The annular magnet 20, the first yoke 30, the second yoke 40, the concentrating tube 50, the speaker assembly 60, and the passive diaphragm 70 can be assembled to each other into a speaker driver 2, which is received in a receiving space 111 of a body 11 of an earphone housing 1 and protected by a cover 13.

The annular magnet 20 comprises a central through hole 21, a first magnetic pole surface 23, and a second magnetic pole surface 25. The first magnetic pole surface 23 and the second magnetic pole surface 25 have different magnetism. For example, the first magnetic pole surface 23 is N pole, and the second magnetic pole surface 25 is S pole. The first magnetic pole surface 23 and the second magnetic pole surface 25 are respectively at two opposite sides of the annular magnet 20. In the embodiment, the first magnetic pole surface 23 and the second magnetic pole surface 25 are, but not limited to, at two opposite sides in an axial direction of the annular magnet 20.

The first yoke 30 is connected to the first magnetic pole surface 23 of the annular magnet 20. The first yoke 30 comprises a central hole 31. The central hole 31 is coaxial with the central through hole 21. The first yoke 30 can be a circular plate shape or other shapes such as a mushroom shape, an umbrella shape, or a funnel shape. In the embodiment, the first yoke 30 comprises an inner axial tube 33 and a contact portion 35. The inner axial tube 33 extends along an axial direction of the central hole 31 and extends to and is disposed in the central through hole 21 of the annular magnet 1020. The contact portion 35 contacts the first magnetic pole surface 23 of the annular magnet 20. In addition, the first yoke 30 comprises a magnetic permeable material of which the magnetism is the same as the first magnetic pole surface 23.

The second yoke 40 comprises a top plate 41 and an outer annular wall 43. The top plate 41 is connected to the second magnetic pole surface 25 of the annular magnet 20. The top plate 41 comprises a central opening 45. The central opening 45 is coaxial with the central through hole 21. The outer annular wall 43 is around a periphery of the top plate 41. In the embodiment, the second yoke 40 comprises a magnetic permeable material of which the magnetism is the same as the second magnetic pole surface 25.

Figure 3:
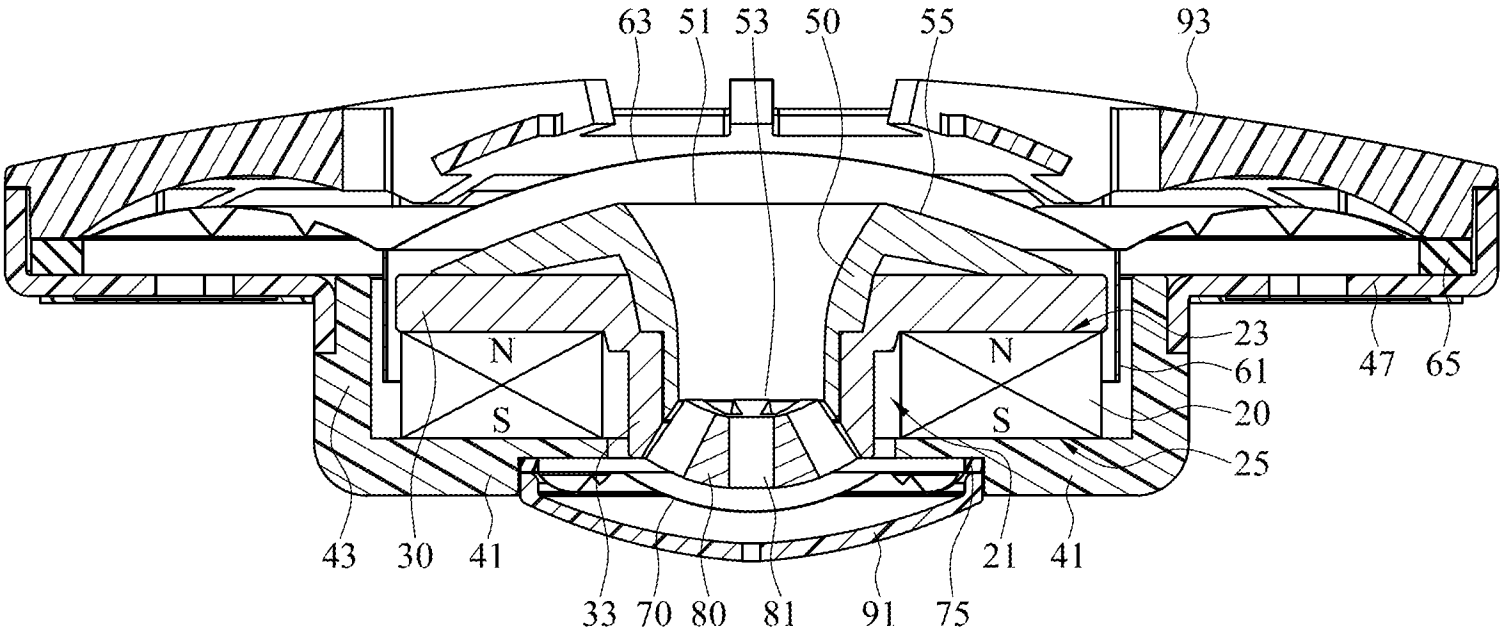
FIG. 3 illustrates a cross sectional view of an earphone device having a concentrating tube according to an embodiment of the instant disclosure.
Figure 4:
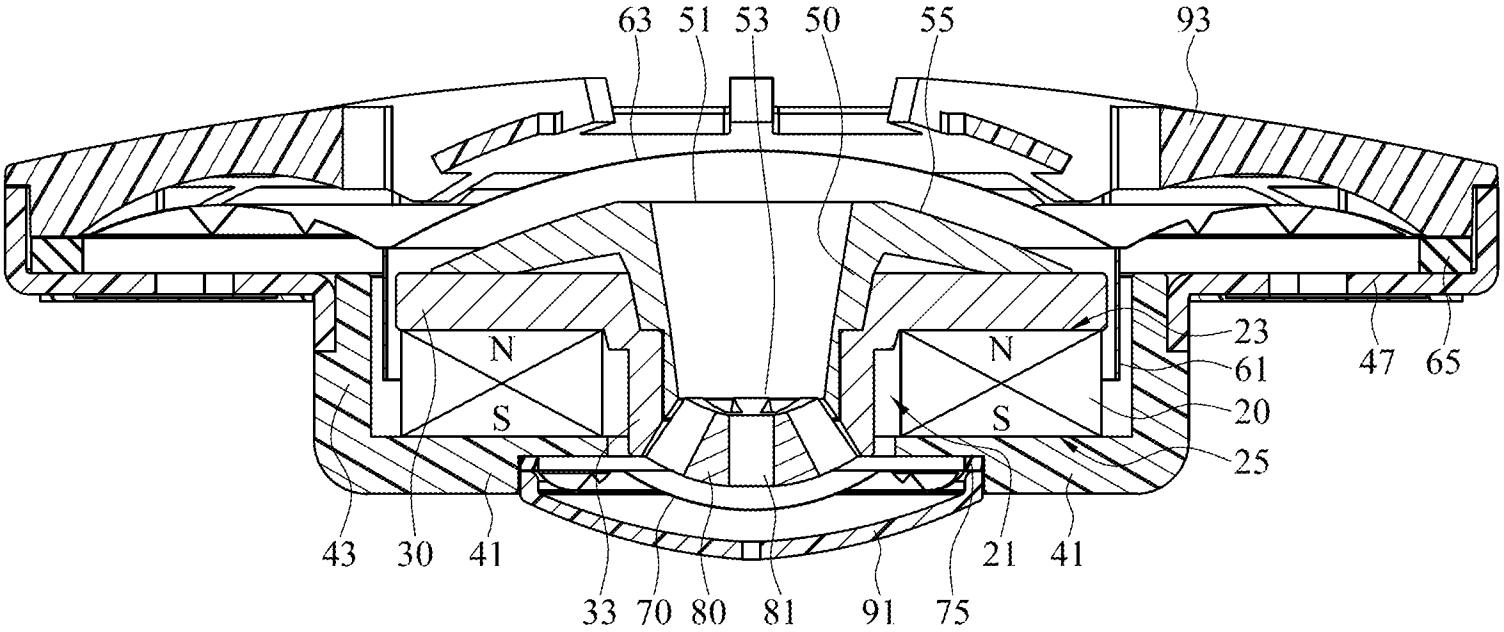
FIG. 4 illustrates a cross sectional view of an earphone device having a concentrating tube according to another embodiment of the instant disclosure.

The concentrating tube 50 is received in the central through hole 21 of the annular magnet 20. The concentrating tube 50 comprises a first open end 51 and a second open end 53. Further, the concentrating tube 50 is fixed in the inner axial tube 33. The concentrating tube 50 can be a tube shape, a cone shape, or other shapes. Please refer to FIG. 3 and FIG. 4, in which FIG. 4 is a cross sectional view of an earphone device having a concentrating tube according to another embodiment of the instant disclosure. A diameter of the first open end 51 of the concentrating tube 50 is greater than or equal to that of the second open end 53. As shown in FIG. 3, the diameter of the first open end 51 of the concentrating tube 50 is greater than that of the second open end 53, and the diameter of the concentrating tube 50 nonlinearly decreases from the first open end 51 towards the second open end 53. As shown in FIG. 4, the diameter of the first open end 51 of the concentrating tube 50 is greater than that of the second open end 53, and the diameter of the concentrating tube 50 linearly decreases from the first open end 51 towards the second open end 53. The decreasing diameter of the concentrating tube 50 allows that gases entering the first open end 51 can be gathered along the concentrating tube 50, and the flow velocity of the gases can be increased.

Further, the concentrating tube 50 further comprises a fixing element 55. The concentrating tube 50 is fixed to the first yoke 30 by the fixing element 55. In the embodiment, the fixing element 55 extends from a periphery of the concentrating tube 50 or is disposed around a peripheral wall of the concentrating tube 50, by which the concentrating tube 50 can be an umbrella shape, a mushroom shape, or a funnel shape.

The speaker assembly 60 comprises a voice coil 61 and an active diaphragm 63. The voice coil 61 is assembled to the active diaphragm 63. As shown in FIG. 3 and FIG. 4, the voice coil 61 extends axially in between the first yoke 30 and the outer annular wall 43. The voice coil 61 is radially spaced from both of the first yoke 30 and the outer annular wall 43 by gaps. In the embodiment, the active diaphragm 63 is a low frequency diaphragm. The voice coil 61 is assembled to an inner concave ring 631 of the active diaphragm 63 by a first fixing ring 65. An outer concave ring 633 of the active diaphragm 63 can be assembled to the second yoke 40. For example, the active diaphragm 63 is assembled to the outer annular wall 43 of the second yoke 40, or the active diaphragm 63 is assembled to a peripheral portion 47 of the second yoke 40. The peripheral portion 47 is around a periphery of the outer annular wall 43.

The passive diaphragm 70 and the active diaphragm 63 are respectively at two opposite ends in an axial direction of the concentrating tube 50. The active diaphragm 63 is close to the first open end 51. The passive diaphragm 70 is close to the second open end 53. In the embodiment, the passive diaphragm 70 is a high frequency diaphragm. An outer concave ring 71 of the passive diaphragm 70 is assembled to an outer side of the top plate 41 of the second yoke 40.

Figure 5A:
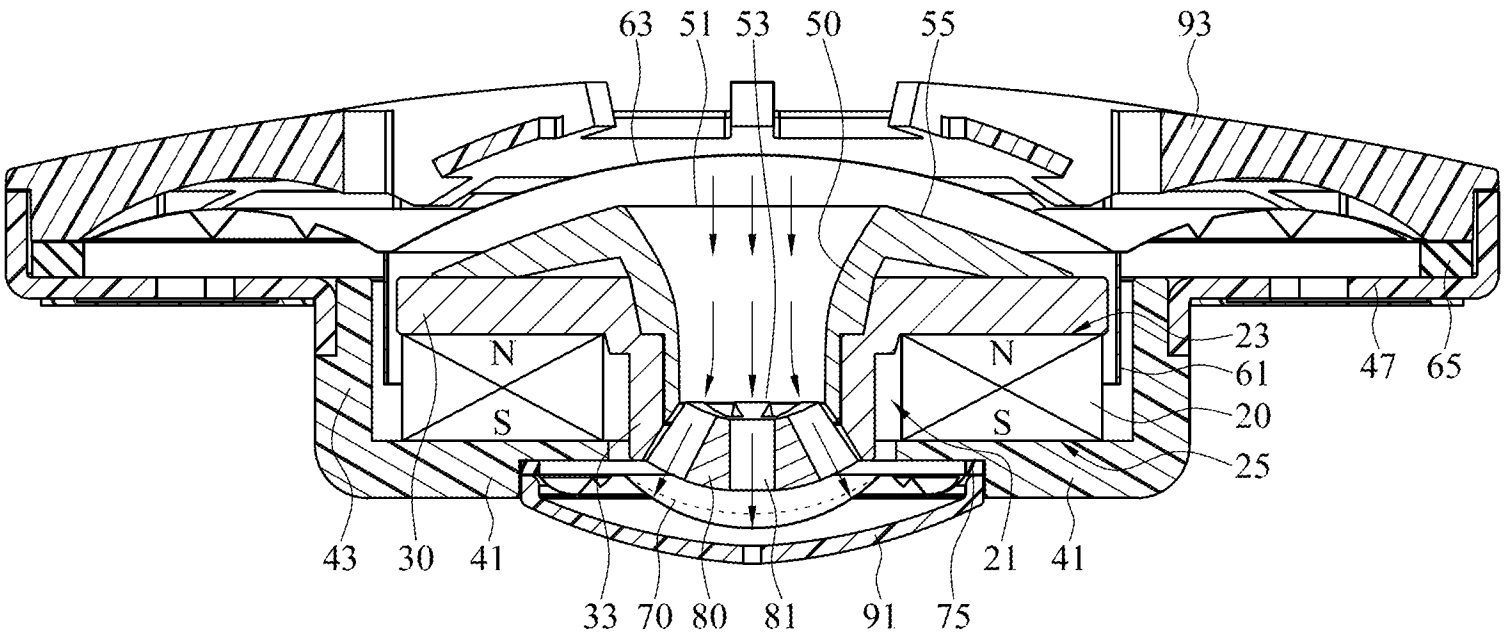
FIG. 5A illustrates a diagram of operation of an earphone device having a concentrating tube according to an embodiment of the instant disclosure.
Figure 5B:
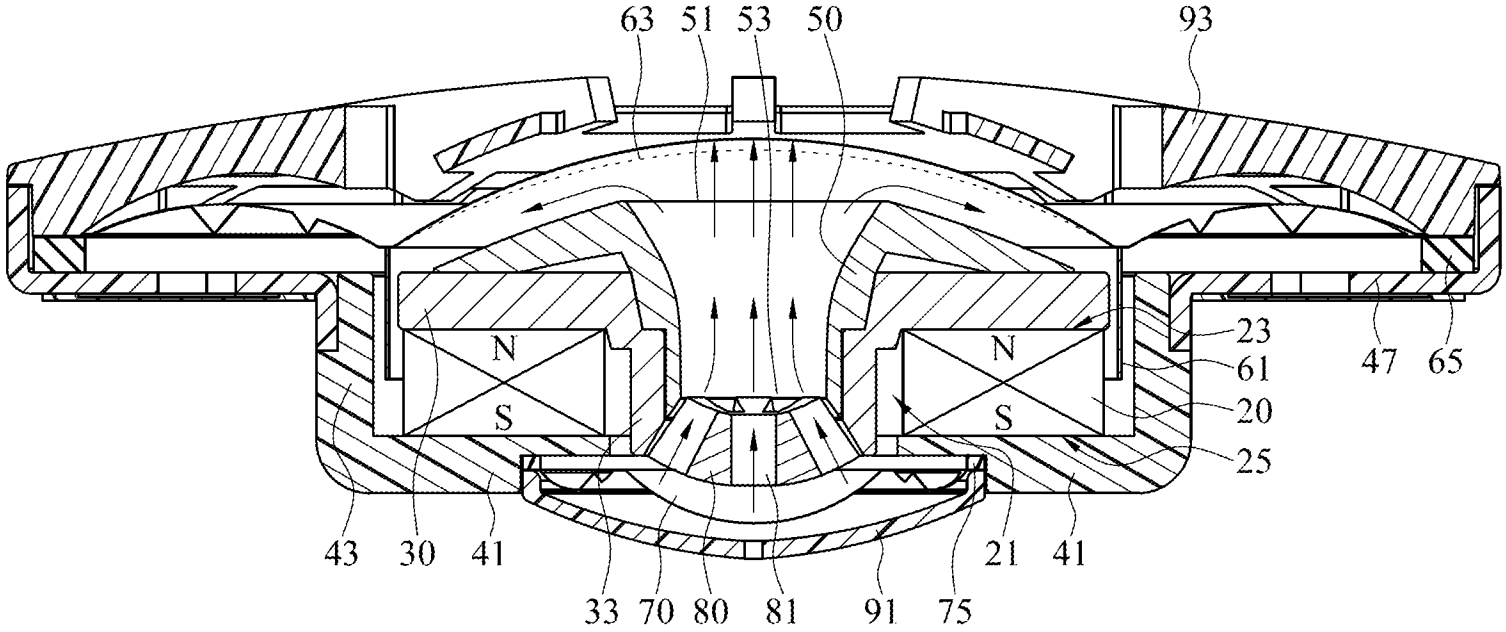
FIG. 5B illustrates a diagram of operation of an earphone device having a concentrating tube according to an embodiment of the instant disclosure.

Please refer to FIG. 5A and FIG. 5B. FIG. 5A and FIG. 5B are diagrams of operation of an earphone device having a concentrating tube according to an embodiment of the instant disclosure. As shown in FIGS. 1, 2A, 2B, 3, and 5A, when the voice coil 61 receives audio signals from an audio line 3 and a circuit board 4, electromagnetic induction occurs, and the voice coil 61 interacts with magnetic lines of force between the first yoke 30 or the annular magnet 20 and the outer annular wall 43 to push and vibrate the active diaphragm 63. A backward gas flow generated by the vibration of the active diaphragm 63 enters the first open end 51 of the concentrating tube 50 and is then gathered and accelerated so as to push the passive diaphragm 70 through the second open end 53. Next, as shown in FIG. 5B, a gas flow generated by the pushed passive diaphragm 70 enters the second open end 53 and outputs towards the first open end 51 to push the active diaphragm 63. In addition, the gas flow generated by the pushed passive diaphragm 70 also transmits acoustic waves produced by the passive diaphragm 70. The acoustic waves are guided and diffused by the fixing element 55, which are similar to the effect of sound diffusion of a speaker.

Figure 6:
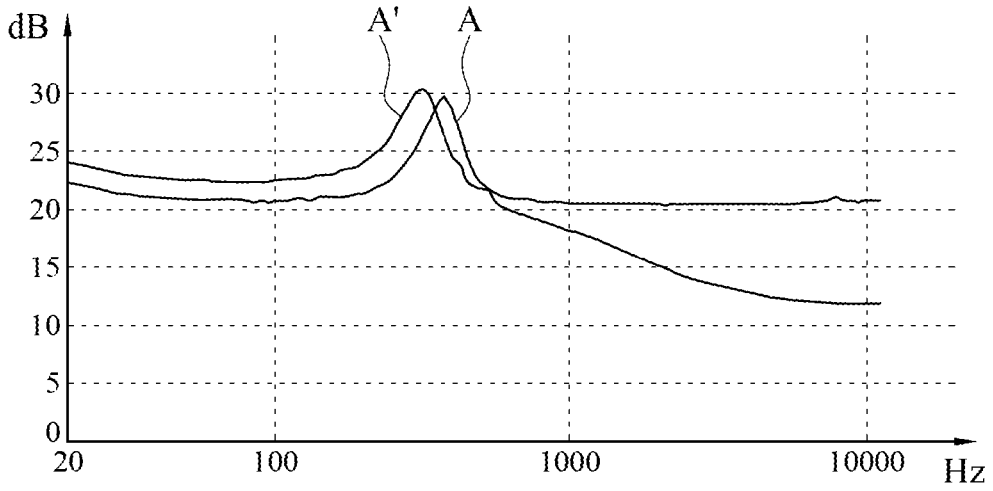
FIG. 6 illustrates a chart showing the lowest resonance frequency of an earphone device having a concentrating tube according to an embodiment of the instant disclosure.

Please refer to FIG. 6, which is a chart showing the lowest resonance frequency of an earphone device having a concentrating tube according to an embodiment of the instant disclosure. As shown in FIG. 6, a curve of resonance frequency of an earphone device having a concentrating tube measured in an experiment is compared with a curve of resonance frequency of an earphone device without any concentrating tube and passive diaphragm measured in the experiment. The frequency-amplitude curve of the earphone device without any concentrating tube and passive diaphragm has a first peak A in a low frequency range. The frequency-amplitude curve of the earphone device having a concentrating tube according to an embodiment of the instant disclosure has a second peak A' in a low frequency range. According to the comparison of the curves measured in the experiment, when the vibration of the passive diaphragm and the active diaphragm of the earphone device having a concentrating tube according to an embodiment of the instant disclosure reaches a dynamic equilibrium, the peak of the lowest resonance frequency shifts to a lower frequency range to reach a frequency raising effect. In the embodiment, the frequency raising effect is reached by the gas flow generated by the passive diaphragm 70 capable of increasing the amplitude of vibration of the active diaphragm 63. It is distinguished from prior arts which consider that the amplitude of vibration of a diaphragm is decreased with the increase of an inner pressure if there is an additional element disposed at the back of a yoke.

The aforementioned configuration of the embodiment is merely for example, but is not a limitation. The instant disclosure also includes embodiments the configuration of active and passive elements of which can be changed. For example, a voice coil is assembled to the inner concave ring 73 of the passive diaphragm 70 shown in the drawings, and the voice coil 61 is removed. Meanwhile, the arrangement of the concentrating tube 50 is reversed, the active diaphragm is a high frequency diaphragm, and the passive diaphragm is a low frequency diaphragm.

Please refer to FIGS. 2A, 2B, 3, and 4, in which the earphone device 100 having the concentrating tube 50 further comprises a dividing unit 80. The dividing unit 80 can be integrated with the concentrating tube 50 into one piece and is at the second open end 53 of the concentrating tube 50. Alternatively, the dividing unit 80 and the concentrating tube 50 can be individually components. As shown in the drawings, the dividing unit 80 and the concentrating tube 50 are individually components. The dividing unit 80 is received in the central through hole 21 of the annular magnet 20 and is close to the second open end 53 of the concentrating tube 50. The dividing unit 80 comprises a plurality of dividing channels 81. The dividing channels 81 are equiangularly arranged and are disposed equally towards the passive diaphragm 70, by which the passive diaphragm 70 can equally bear gas flows. Further, the dividing unit 80 is fixed to an end of the inner axial tube 33. When the dividing unit 80 and the concentrating tube 50 are integrated into one piece, the dividing channels 81 are equiangularly arranged in the second open end 53 of the concentrating tube 50.

Please refer to FIGS. 2A, 2B, 3, and 4, in which the earphone device 100 having the concentrating tube 50 further comprises a protective cover 91 and a protective net 93. The protective cover 91 is assembled to the outer side of the top plate 41 of the second yoke 40. The passive diaphragm 70 is between the top plate 41 and the protective cover 91. The protective net 93 is assembled to the second yoke 40. For example, the protective net 93 is assembled to the peripheral portion 47 and is opposite to the protective cover 91. The active diaphragm 63 is between the second yoke 40 and the protective net 93.

Figure 2A:
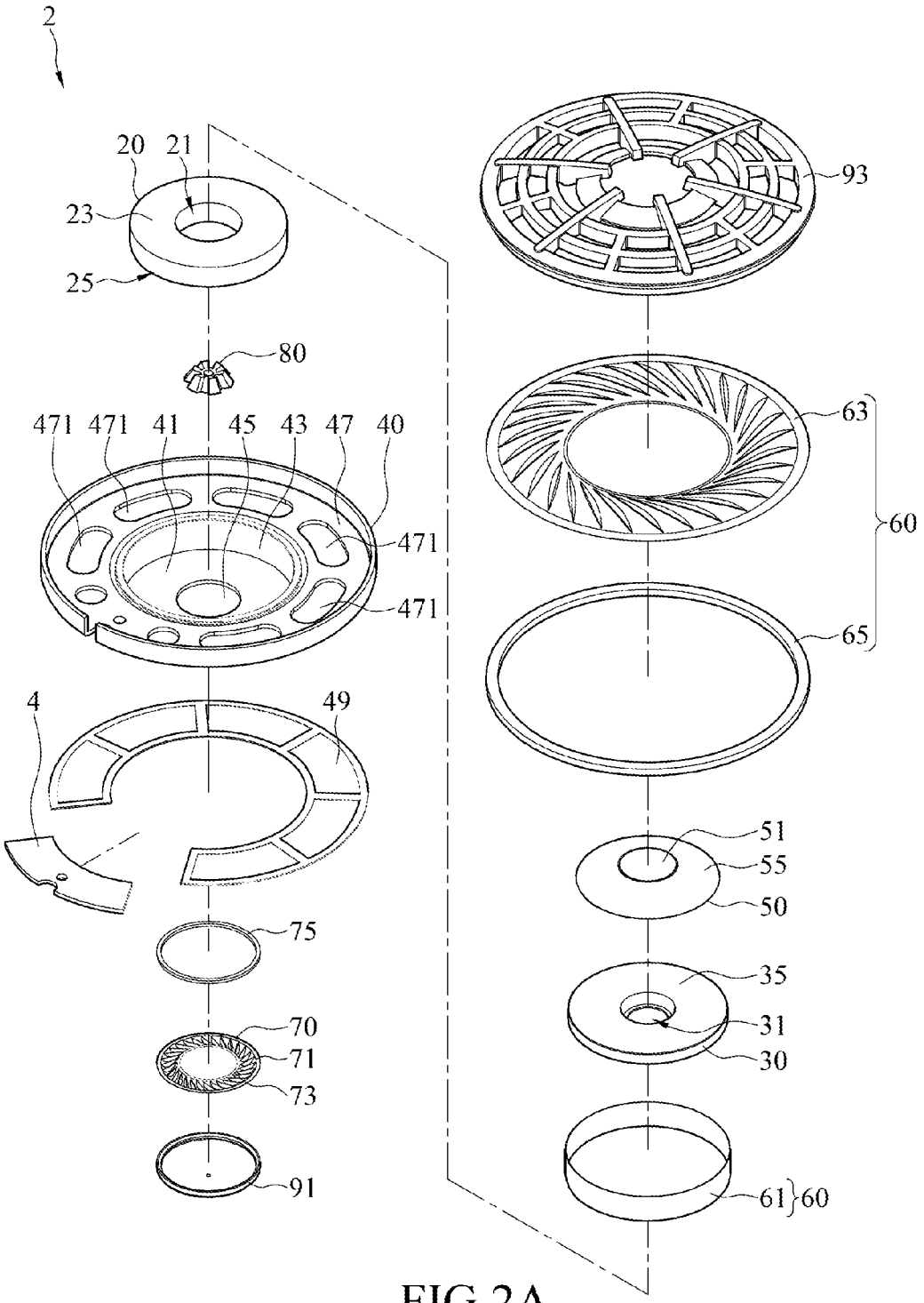
FIG. 2A illustrates an exploded view in a viewing angle of an earphone device having a concentrating tube according to an embodiment of the instant disclosure.
Figure 2B:
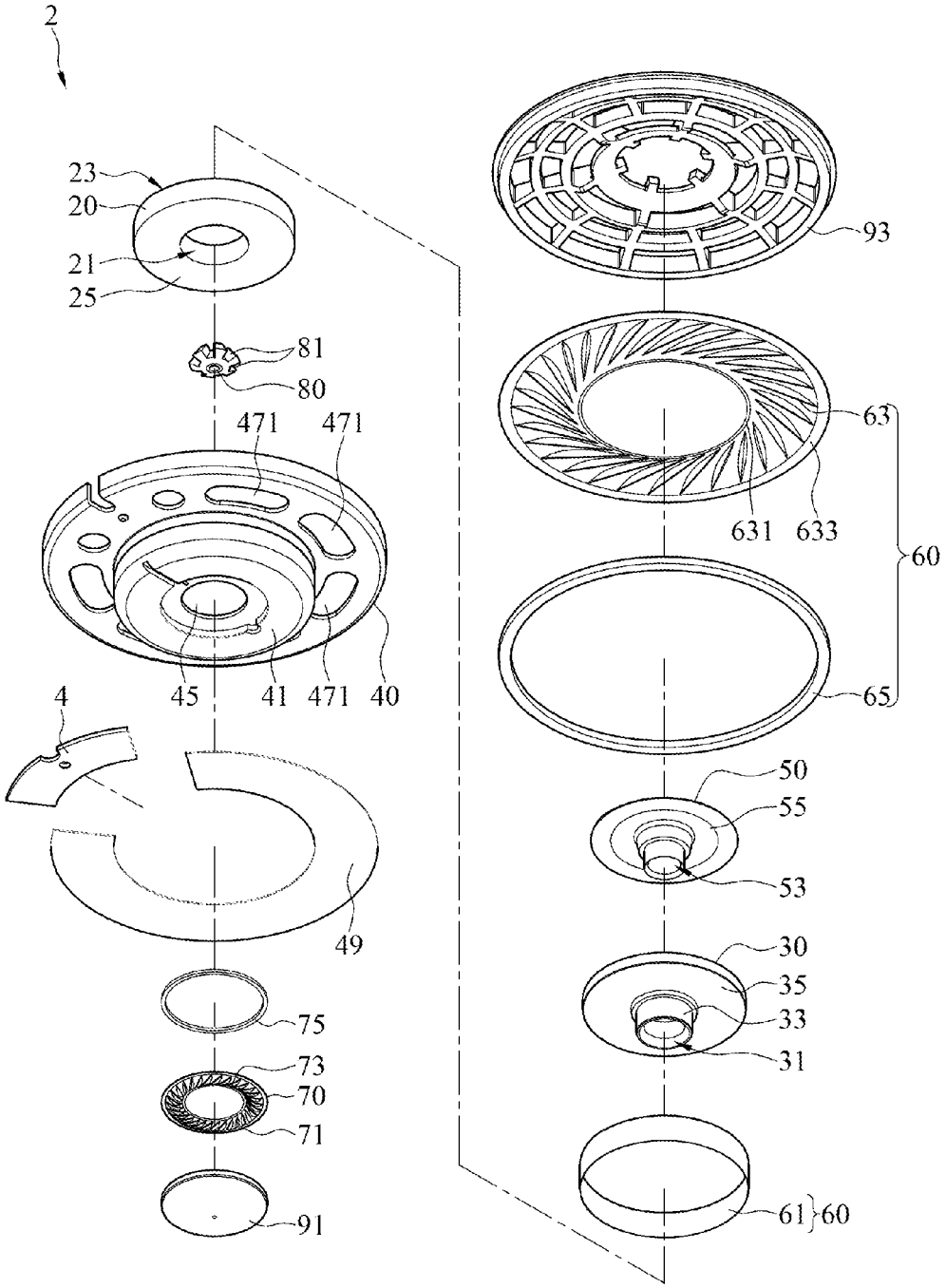
FIG. 2B illustrates an exploded view in another viewing angle of an earphone device having a concentrating tube according to an embodiment of the instant disclosure.
Figure 7:
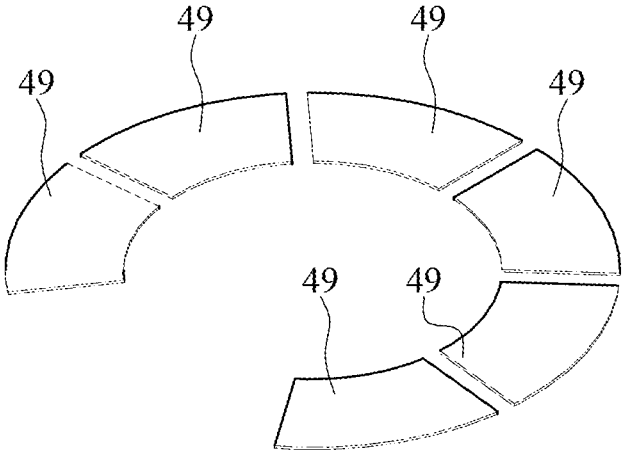
FIG. 7 illustrates a perspective view of a tuning plate according to another embodiment of the instant disclosure.

Please refer to FIGS. 2A and 2B, in which the peripheral portion 47 of the second yoke 40 comprises a plurality of gas holes 471. The gas holes 471 can have different shapes, sizes, and arrangements. The gas holes 471 are utilized for regulating the pressure of gas in the front and in the back of the receiving space 111. Further, at least one tuning plate 49 can be attached to the second yoke 40. As shown in FIG. 2B, the tuning plate 49 is one piece of component, which covers plural gas holes 471. Alternatively, as shown in FIG. 7, there is a plurality of tuning plates 49, and each of the tuning plates 49 is attached to one corresponding gas hole 471. The tuning plate(s) 49 can be utilized for regulating the amount of gas transferred between the front and the back of the receiving space 111 and regulating the pressure of gas in the front and in the back of the receiving space 111, by which regulating the amplitude of vibration of the active diaphragm 63 and the passive diaphragm 70, and regulating the resonance frequency of the earphone device 100 having the concentrating tube 50.

Concisely, the earphone device 100 according to above embodiments comprises the concentrating tube 50, the active diaphragm 63, and the passive diaphragm 70. The earphone device 100 is suitable for use in terms of size because only one diaphragm is added, and two moving coil drivers are not required. In addition, a gas flow generated by the active diaphragm 63 is gathered by the concentrating tube 50 and then pushes and vibrates the passive diaphragm 70. A gas flow generated by the passive diaphragm 70 transmits acoustic waves and returns to the active diaphragm 63, which not only reinforces a part of frequency of sound being unclear in the situation that the sound is only generated by the active diaphragm 63 but also increases the amplitude of vibration of the active diaphragm 63 to reach a frequency raising effect by pushing the active diaphragm 63. As a result, the frequency of sound can be reinforced, and the prejudice of prior arts considering that an element on a diaphragm causes the increase of the inner pressure to decrease the amplitude of vibration of the diaphragm is overcome.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. An earphone device having a concentrating tube, comprising:

an annular magnet comprising a central through hole, a first magnetic pole surface, and a second magnetic pole surface, the first magnetic pole surface and the second magnetic pole surface having different magnetism and being respectively at two opposite sides of the annular magnet;

a first yoke connected to the first magnetic pole surface of the annular magnet, the first yoke comprising a central hole coaxial with the central through hole;

a second yoke comprising a top plate and an outer annular wall, the top plate being connected to the second magnetic pole surface of the annular magnet, the top plate comprising a central opening coaxial with the central through hole, the outer annular wall being around a periphery of the top plate;

a concentrating tube received in the central through hole of the annular magnet, the concentrating tube comprising a first open end and a second open end, wherein a diameter of the first open end of the concentrating tube is greater than that of the second open end of the concentrating tube;

a speaker assembly comprising a voice coil and an active diaphragm, the voice coil being assembled to the active diaphragm and extending axially in between the first yoke and the outer annular wall, the voice coil being radially spaced from both of the first yoke and the outer annular wall by gaps; and a passive diaphragm, the passive diaphragm and the active diaphragm being respectively at two opposite ends in an axial direction of the concentrating tube, wherein the active diaphragm is close to the first open end, and the passive diaphragm is close to the second open end.

2. The earphone device having a concentrating tube of claim 1, wherein the diameter of the concentrating tube linearly decreases from the first open end towards the second open end.

3. The earphone device having a concentrating tube of claim 1, wherein the diameter of the concentrating tube nonlinearly decreases from the first open end towards the second open end.

4. The earphone device having a concentrating tube of claim 1, wherein a plurality of dividing channels are disposed in the second open end of the concentrating tube, and the dividing channels are equiangularly arranged.

5. The earphone device having a concentrating tube of claim 1, wherein the first yoke further comprises an inner axial tube, the inner axial tube extends along an axial direction of the central hole and is disposed in the central through hole of the annular magnet, and the concentrating tube is fixed in the inner axial tube.

6. The earphone device having a concentrating tube of claim 1, further comprising a dividing unit, the dividing unit being received in the central through hole of the annular magnet and close to the second open end of the concentrating tube, the dividing unit comprising a plurality of dividing channels, and the dividing channels being equiangularly arranged.

7. The earphone device having a concentrating tube of claim 6, wherein the first yoke further comprises an inner axial tube, the inner axial tube extends along an axial direction of the central hole and is disposed in the central through hole of the annular magnet, and the dividing unit is fixed to an end of the inner axial tube.

8. The earphone device having a concentrating tube of claim 1, wherein the concentrating tube further comprises a fixing element and the concentrating tube is fixed to the first yoke by the fixing element.

9. The earphone device having a concentrating tube of claim 1, wherein the passive diaphragm is fixed to the top plate of the second yoke, and the active diaphragm is fixed to the outer annular wall of the second yoke.

* * * * *